US007165479B1

(12) United States Patent
Lee

(10) Patent No.: US 7,165,479 B1
(45) Date of Patent: Jan. 23, 2007

(54) SELECTIVE ONE-WAY WRENCH

(76) Inventor: Yi Min Lee, No.62, Renmel Rd., Dali City, Taichung County (TW) 412

( * ) Notice: Subject to any disclaimer, the term of this patent is extended or adjusted under 35 U.S.C. 154(b) by 0 days.

(21) Appl. No.: 11/225,464

(22) Filed: Sep. 13, 2005

(51) Int. Cl.
*B25B 13/46* (2006.01)

(52) U.S. Cl. ..... 81/60; 81/63.2

(58) Field of Classification Search ..... 81/60–63.2
See application file for complete search history.

(56) References Cited

U.S. PATENT DOCUMENTS 6,408,722 B1 * 6/2002 Chen ..... 81/60
6,655,237 B1 * 12/2003 Chen ..... 81/60
6,752,046 B1 * 6/2004 Lee ..... 81/60
6,807,881 B1 * 10/2004 Wu ..... 81/59.1
6,948,406 B1 * 9/2005 Li ..... 81/63.2
6,955,104 B1 * 10/2005 Hu ..... 81/63.2
2004/0016322 A1 * 1/2004 Hu ..... 81/60
2005/0241443 A1 * 11/2005 Chen ..... 81/60

* cited by examiner

*Primary Examiner*—David B. Thomas
(74) *Attorney, Agent, or Firm*—Banger Shia

(57) ABSTRACT

There is disclosed a selective one-way wrench with a device for retaining a socket. The selective one-way wrench includes a handle and a head formed at an end of the handle. The retaining device includes a cover installed on the head. Two parallel grooves are defined in the internal side of the cover. A stop is formed between the grooves. A shackle is put between the cover and the head. The shackle includes two slides sliding in the grooves. The shackle defines an opening larger than the socket. The shackle includes a retaining portion at a front end. An arched leaf spring is compressed between the shackle and the stop. Thus, the shackle is normally at a locking position and will be returned to the locking position after it is moved and released. Because of the above-mentioned design, the socket can easily be retained and released. As the slides slide in the grooves, the operation of the retaining device is smooth. Therefore, its lifecycle is long.

4 Claims, 6 Drawing Sheets

SELECTIVE ONE-WAY WRENCH

BACKGROUND OF INVENTION

1. Field of Invention

The present invention relates to a selective one-way wrench and, more particularly, to a selective one-way wrench with a device for retaining a socket.

2. Related Prior Art

A selective one-way wrench is a hand tool with which a user can select from two directions of driving a socket in order to tighten or loosen a nut or screw. In use, as it can be pivoted in an opposite direction without driving the socket, saved are the troubles in disengaging the socket from the nut or bolt and engaging the socket with the nut or bolt repeatedly. Hence, it is popular. The socket is inserted in a selective one-way mechanism of the selective one-way wrench. The polygonal periphery of the socket is fit in a polygonal hole of the selective one-way mechanism. The selective one-way wrench is often used in a horizontal surface. Hence, a user often has to hold the selective one-way wrench with a hand and the socket with the other hand in order to prevent the socket from dropping.

In order to solve the problems related to the retaining of the socket, most selective one-way wrenches include a detent biased by means of a spring. The recovering force of the spring is used for retaining and disengaging. If the elastic coefficient of the spring is too small, the retaining is not effective. If the elastic coefficient of the spring is too large, it requires a strong pushing force to insert the socket and a strong pulling force to disengage the socket. The operation demands a lot of labor and is inconvenient. Moreover, after some time of use, the detent and the socket soon wears, thus compromising its lifecycle.

In order to eliminate the above-addressed problems, the inventor of the present invention has devised a selective one-way wrench with a device 70 for retaining a socket 60 as shown in FIG. 8. The retaining device 70 includes a pushing strip 71 on a side of a handle 50 facing a selective one-way mechanism 55. A spring 72 is compressed between the pushing strip 71 and the handle 50. The pushing strip 71 will be returned after it is moved and released. The pushing strip 71 includes, at an end, a detaining strip 75 inserted into an opening of the selective one-way mechanism 55. The retaining strip 75 can be inserted in and moved from a groove 65 in the periphery of the socket 60. By pushing forwards the pushing strip 71, a user moves the retaining strip 75 from the groove 65 of the socket 60 so that the socket 60 can be disengaged from the selective one-way mechanism 55. On the contrary, as the pushing strip 71 is released and returned, the retaining strip 75 is inserted into the groove 65 of the socket 60. As mentioned above, the operation is convenient and saves labor.

The retaining device 70 performs better than the spring-biased detents. However, after further studies, it has been found that the use is not perfectly smooth as the pushing strip 71 is installed on one side of the handle 50. Moreover, it is inconvenient for the user to move his or her thumb from the selective one-way mechanism 55 to the pushing strip 71 as the pushing strip 71 is installed on one side of the selective one-way mechanism 55. Hence, there is room for improvement.

The present invention is therefore intended to obviate or at least alleviate the problems encountered in prior art.

SUMMARY OF INVENTION

The primary objective of the present invention is to the selective one-way wrench can be operated easily and smoothly and improves its economic gain.

According to the present invention, a selective one-way wrench includes a handle, a head formed at an end of the handle, a selective one-way mechanism installed at the head, and a retaining device for retaining a socket on the selective one-way mechanism. The retaining device includes a cover and a shackle provided between the cover and the head movably. The cover includes an opening through which the socket can be inserted, a stop on a side, and two parallel grooves between two lateral walls thereof and two lateral walls of the stop. The shackle includes an opening larger than the socket, two slides for sliding in the grooves, and a retaining portion for entering a groove in the periphery of the socket when the shackle is moved backwards. Hence, the selective one-way wrench can be operated easily and smoothly.

Other objectives, advantages and novel features of the invention will become more apparent from the following detailed description in conjunction with the attached drawings.

BRIEF DESCRIPTION OF DRAWINGS

The present invention will be described through detailed illustration of the preferred embodiment referring to the drawings.

DETAILED DESCRIPTION OF PREFERRED EMBODIMENT

Figure 1:
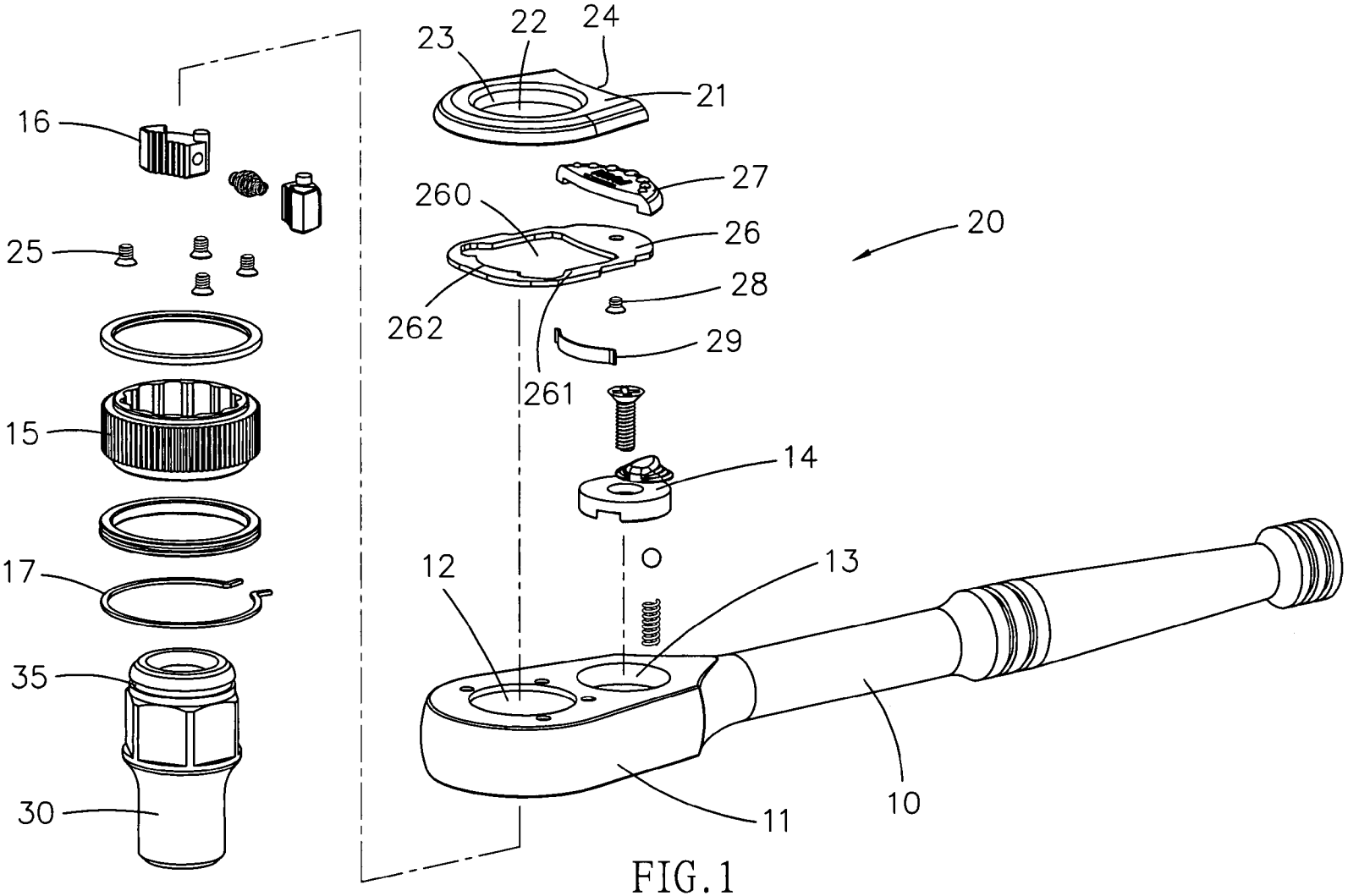
FIG. 1 is an exploded view of a selective one-way wrench according to the preferred embodiment of the present invention.
Figure 2:
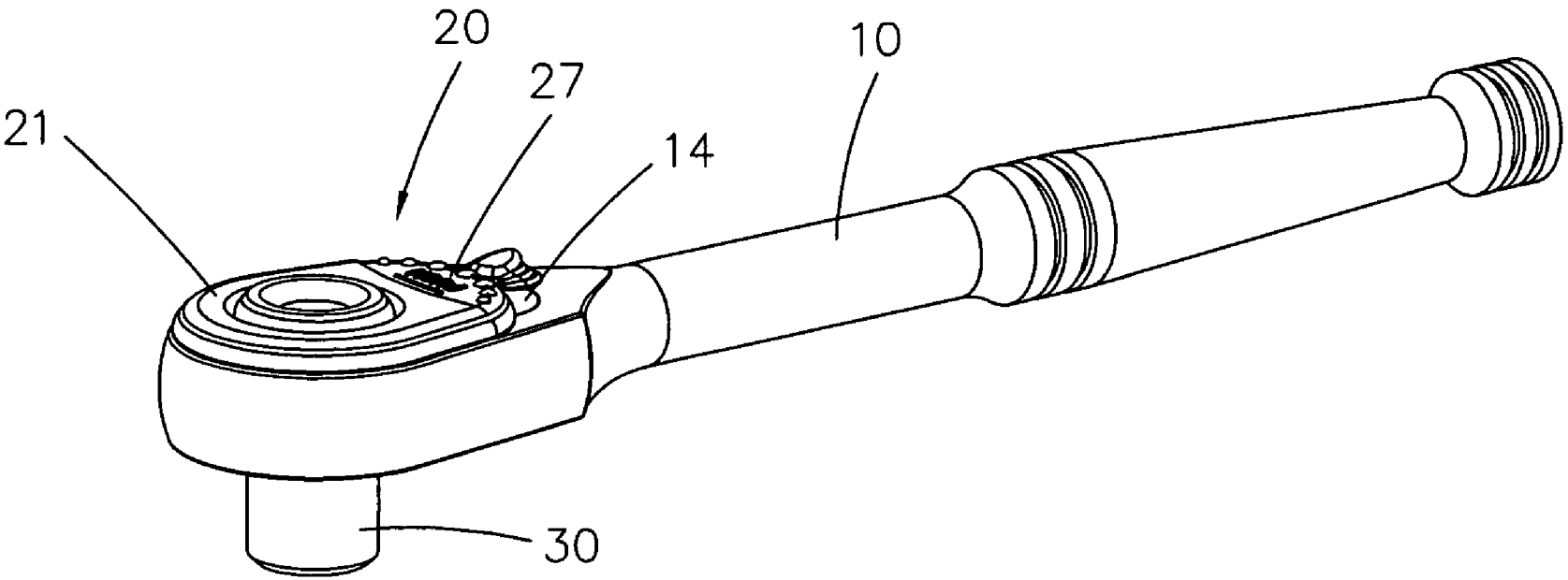
FIG. 2 is a perspective view of the selective one-way wrench shown in FIG. 1.

Referring to FIGS. 1 and 2, there is shown a selective one-way wrench according to the preferred embodiment of the present invention. The selective one-way wrench includes a handle 10, a head 11 formed at an end of the handle 10 and a selective-one way mechanism installed on the head 11. The head 11 defines a space 12 and a cavity 13 communicated with the space 12. A switch 14 is put in the cavity 13. An annular gear 15 is retained in the space 12 by means of a C-clip 17. The annular gear 15 can be engaged with a socket 30. Two pawls 16 are put between the switch 14 and the annular gear 15. The direction of the rotational of the annular gear 15 is controlled by means of the switch 14 through the pawls 16. As being conventional and not the spirit of the present invention, the foregoing elements will not be described in detail. Furthermore, the selective one-way wrench includes a device 20 for retaining a socket 30 on the head 11.

Referring to FIGS. 1 through 4, the retaining device 20 includes a cover 21 installed on the head 11. The cover 21 includes an opening 22 corresponding to the socket 30. A U-shaped stop 23 is formed on an internal side of the cover 21 around the opening 22. Two grooves 24 are defined in the internal side of the cover 21 between two lateral walls (not numbered) of the cover 21 and two lateral walls (not numbered) of the U-shaped stop 23. Four screws 25 are driven into four screw holes (not numbered) defined in the U-shaped stop 23 through four apertures (not numbered) defined in the roof (not numbered) of the space 12 in order to secure the cover 21 to the roof of the space 12.

Figures 3, 4:
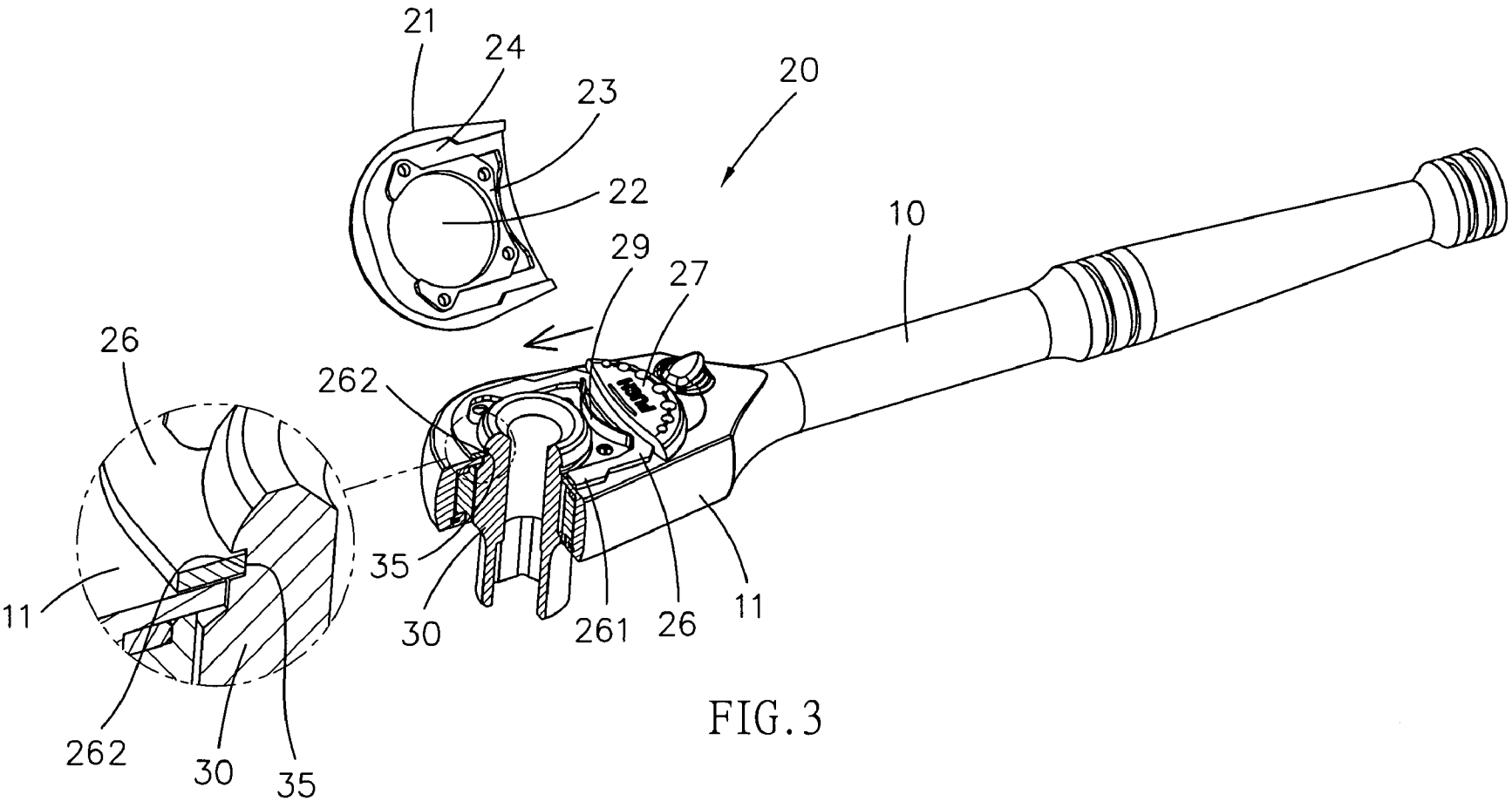
FIG. 3 is a cutaway perspective view of the selective one-way wrench shown in FIG. 2 ready for retaining a socket.
FIG. 4 is an enlarged partial view of the selective one-way wrench shown in FIG. 3.
Figure 5:
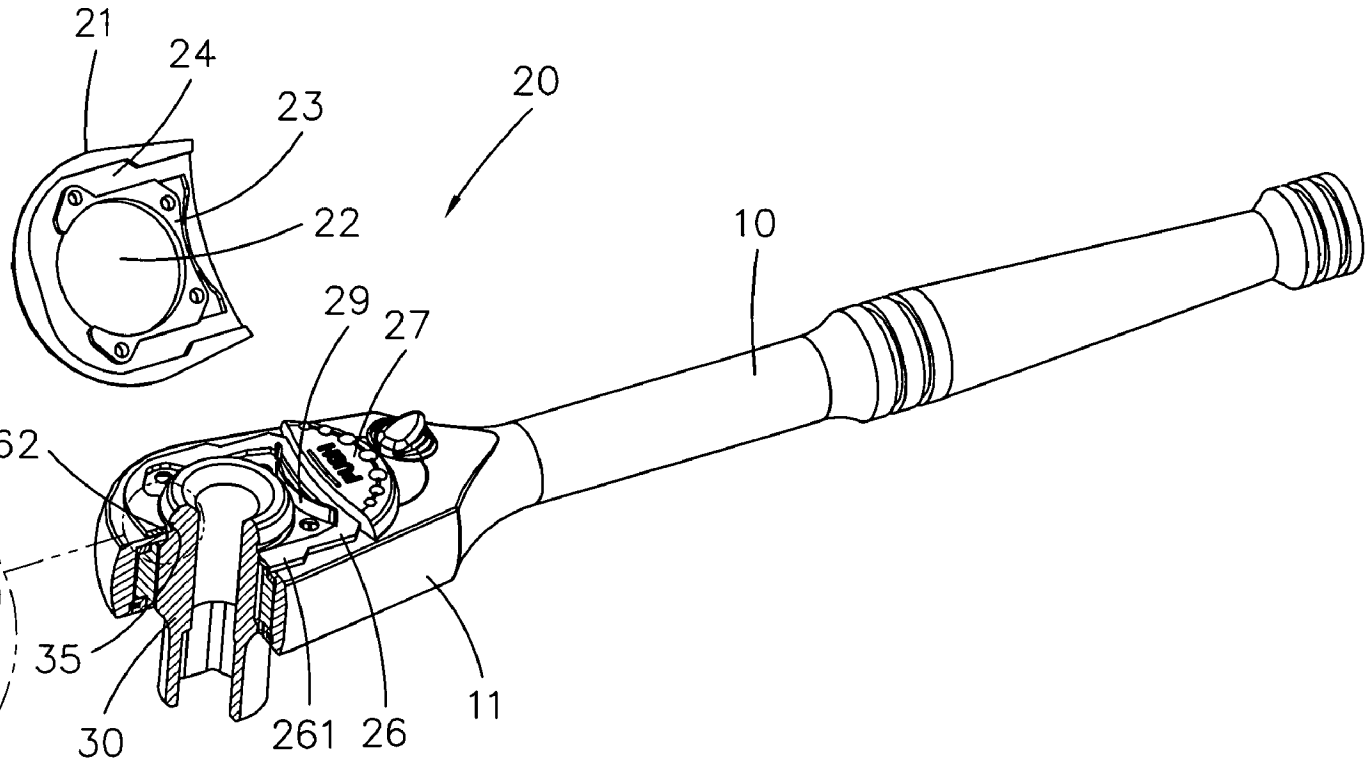
FIG. 5 is similar to FIG. 3 but shows the selective one-way wrench ready for releasing the socket.
Figure 6:
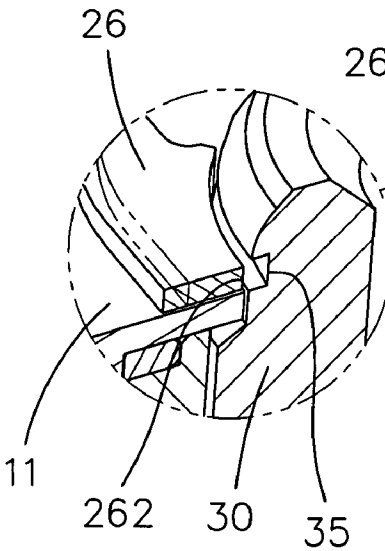
FIG. 6 is an enlarged partial view of the selective one-way wrench shown in FIG. 5.
Figure 7:
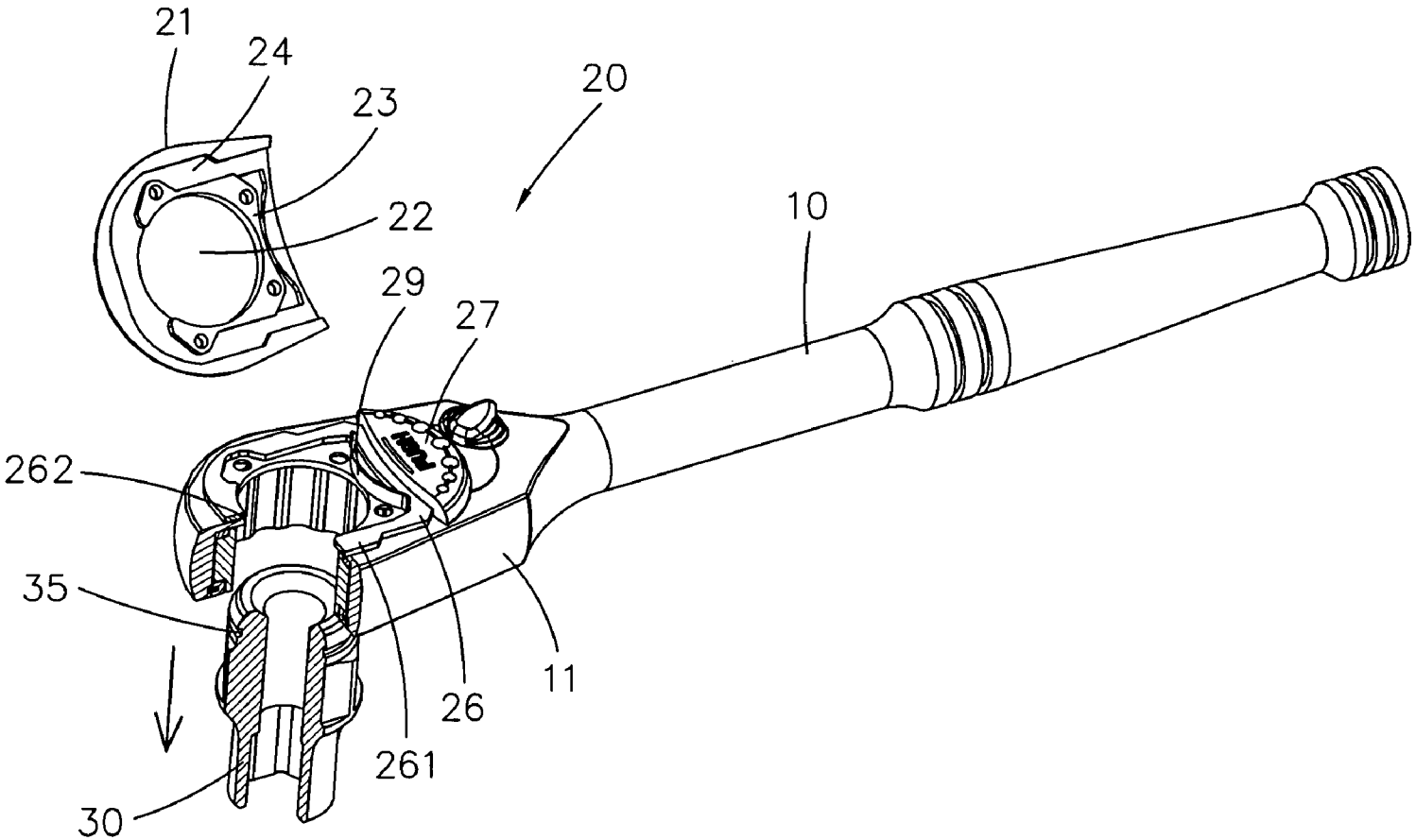
FIG. 7 is similar to FIG. 5 but shows the socket released from the selective one-way wrench.
Figure 8:
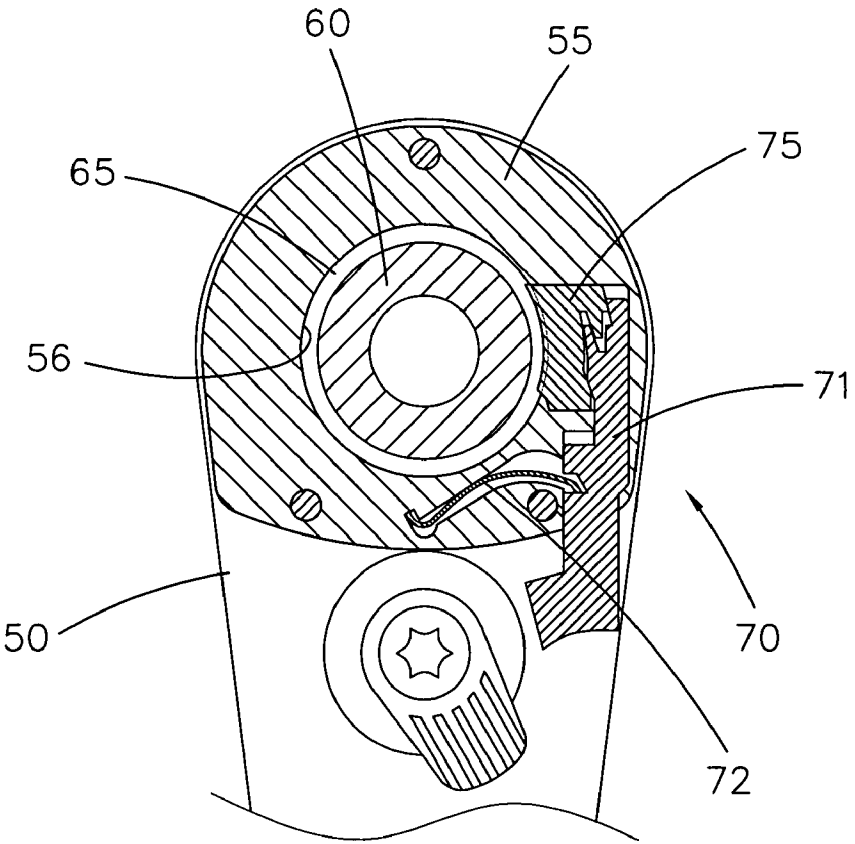
FIG. 8 PRIOR ART
FIG. 8 is a cutaway top view of a conventional selective one-way wrench.

A shackle 26 is put between the cover 21 and the head 11. The shackle 26 defines an opening 260 larger than the socket 30 so that the socket 30 can be inserted through the opening 260. The shackle 26 includes, on two sides of the opening 260, two slides 261 put movably in the grooves 24 so that the shackle 26 can slide smoothly with respect to the cover 21 and the socket 30. The shackle 26 includes, at a front end, a retaining portion 262 for entering a groove 35 in the periphery of the socket 30 as the shackle 26 is moved backwards relative to the head 11 and the cover 21. A friction plate 27 is secured to the shackle 26 by means of a screw 28 so that a user can easily move the shackle 26 by pushing the friction plate 27. A spring 29 is put between the cover 21 and the head 11. The spring 29 is compressed between the U-shaped stop 23 and the shackle 26. The spring 29 may be an arched leaf spring with a middle point against a rear portion of the U-shaped stop 23 and a rear portion of the shackle 26. The shackle 26 is automatically moved backwards in order to lock the socket 30 as shown in FIGS. 3 and 4.

Therefore, according to the present invention, there is provided a selective one-way wrench that can be operated easily and smoothly.

The operation of the selective one-way wrench will be described in detail referring to FIGS. 3 through 7. Wishing to insert the socket 30 into the selective one-way mechanism, the user pushes the friction plate 27 in order to move the shackle 26 forwards and align the opening 260 of the shackle 26 with an opening of the selective one-way mechanism. Then, the user inserts socket 30 into the opening of selective one-way mechanism. Then, the user aligns the groove 35 of the socket 30 with the retaining portion 262 of the shackle 26. Then, the user releases the friction plate 27. Now, the shackle 26 is moved backwards by means of the spring 29 so that the retaining portion 262 of the shackle 26 is put into the groove 35. Hence, the socket 30 is retained.

On the contrary, wishing to release the socket 30, the user pushes the friction plate 27 in order to move the shackle 26. The retaining portion 262 is moved from the groove 35, and the opening 260 is aligned with the opening of the selective one-way mechanism. Now, the user moves the socket 30 from the selective one-way wrench.

As discussed above, the retaining device 20 is located in the center of the head 11 corresponding to the user's thumb so that the user can easily operate it. Moreover, as the slides 261 of the shackle 26 slide smoothly on two sides of the socket 30 so that the operation of retaining device 20 is smooth and that stress concentration will not occur.

The present invention has been described through the detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A selective one-way wrench comprising a handle (10), a head (11) formed at an end of the handle (10), a selective one-way mechanism installed at the head (11), and a retaining device (20) for retaining a socket (30) on the head (11), the retaining device (20) comprising:

a cover (21) installed on the head (11), the cover (21) comprising an opening (22) through which the socket (30) can be inserted, a stop (23) on a side, and two parallel grooves (24) between two lateral walls thereof and two lateral walls of the stop (23); and a shackle (26) put between the cover (21) and the head (11) movably, the shackle (26) comprising an opening (260) larger than the socket (30), two slides (261) for sliding in the grooves (24), and a retaining portion (262) for entering a groove (35) in the periphery of the socket (30) when the shackle (26) is moved backwards so that the selective one-way wrench can be operated easily and smoothly.

2. The selective one-way wrench according to claim 1 comprising screws (25) for attaching the cover (21) to the head (11).

3. The selective one-way wrench according to claim 1 comprising a friction plate (27) secured to the shackle (26) so that by pushing the friction plate (27), a user easily moves the shackle (26).

4. The selective one-way wrench according to claim 1 or 3 comprising a spring (29) compressed between the shackle (26) and the stop (23) so that the shackle (26) is moved backwards automatically.

* * * * *